United States Patent [19]

Jacobs et al.

[11] Patent Number: 4,910,433

[45] Date of Patent: Mar. 20, 1990

[54] EMITTERLESS SDN ELECTRODE

[75] Inventors: Cornelis A. J. Jacobs; Jan R. De Bie; Peter A. W. Tielemans, all of Eindhoven, Netherlands

[73] Assignee: U.S. Philips Corp., New York, N.Y.

[21] Appl. No.: 684,155

[22] Filed: Dec. 20, 1984

Related U.S. Application Data

[63] Continuation of Ser. No. 593,781, Mar. 27, 1984, abandoned, which is a continuation of Ser. No. 295,051, Aug. 21, 1981, abandoned.

[30] Foreign Application Priority Data

Sep. 5, 1980 [NL] Netherlands ..... 8005025

[51] Int. Cl.[4] ..... H01J 61/04

[52] U.S. Cl. ..... 313/631; 313/574

[58] Field of Search ..... 313/631, 633, 572, 574, 313/692

[56] References Cited

U.S. PATENT DOCUMENTS

| | | | |
|---|---|---|---|
| 3,134,924 | 5/1964 | Henderson et al. | 313/633 |
| 3,476,969 | 11/1969 | Ennulat et al. | 313/317 X |
| 4,136,227 | 1/1979 | Saito et al. | 313/633 |
| 4,260,929 | 4/1981 | Jacobs et al. | 313/642 X |

FOREIGN PATENT DOCUMENTS 890691 6/1987 Netherlands .

*Primary Examiner*—Sandra O'Shea

*Attorney, Agent, or Firm*—Emmanuel J. Lobato

[57] ABSTRACT

The invention relates to a high-pressure sodium vapor discharge lamp having a ceramic discharge vessel. In addition to sodium and possibly mercury the discharge vessel also comprises a rare gas. In the discharge vessel an electrode of a refractory metal is accommodated. In the operating condition of the lamp the discharge emanates from the tip of the electrode. According to the invention the electrode is free from alkaline earth metals and the electrode tip in the operating condition of the lamp has a temperature between 2400 K and 2700 K. Disappearance of sodium caused by the electrode material is prevented in this manner.

22 Claims, 1 Drawing Sheet

EMITTERLESS SDN ELECTRODE

Figure 1:
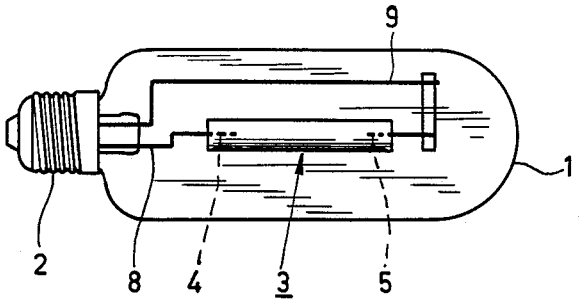

This is a continuation application of prior copending application Ser. No. 593,781, filed March 27, 1984 and now abandoned, which was a continuation application of prior copending application Ser. No. 295,051, filed Aug. 21, 1981, and now abandoned.

The invention relates to a high-pressure sodium vapor discharge lamp having a ceramic discharge vessel having a filling which contains sodium and a rare gas and through the wall of which at least one current supply conductor extends to an electrode of a refractory metal arranged in the discharge vessel, from the tip of which electrode the discharge emanates in the operating condition of the lamp. Such lamps are nowadays used on a large scale and have the advantage of a high specific luminous efficacy. The discharge vessel consists of crystalline oxide which can withstand sodium vapor, for example, monocrystalline saphire or densely sintered polycrystalline aluminium oxide. In addition to sodium and one or more rare gases, the filling of the discharge vessel may also include mercury.

A known problem in such lamps is the disappearance of sodium from the vapor filling under the influence of material released from the electrodes, which disappearance gives rise to an increase of the lamp voltage. A measure to check the disappearance of sodium is known from Netherlands Patent Application 7713348 (and corresponding U.S. Pat. No. 4,420,708) and consists in that the electrode comprises an electron emitter consisting of alkaline earth oxides and tungsten oxide in a molecular ratio between 8 and 50. It has been found that this measure only partly prevents this form of sodium disappearance. It is the object of the invention to provide high-pressure sodium vapor discharge lamps of the kind mentioned in the opening paragraph in which the disappearance of sodium due to the electrode material is prevented substantially entirely.

According to the invention this object is achieved in that the electrode is free from alkaline earth metals and that in the operating condition of the lamp the electrode tip has a temperature between 2400 K and 2700 K.

It has been found that in lamps according to the invention no disappearance of sodium occurs due to the effect of material originating from the electrodes. It is surprising that a comparatively low value of the temperature of the electrode tip proves to be sufficient to obtain sufficient electron emission in the operating condition of the lamp. However, the temperature of the electrode tip should be in the above-indicated range. If in fact said temperature is higher than 2700 K, the electrode material will show too much evaporation. The evaporated material then condenses on the comparatively cold wall of the discharge vessel, which leads to blackening of the wall. If the temperature of the electrode tip remains lower than 2400 K, the phenomenon occurs that the arc does not emanate from the electrode tip in a stable manner. As a result of this the lamp will operate in an unstable manner and failure of the lamp may even occur.

The invention is based on the following recognition. In the known lamps the electrodes comprise alkaline earth metals-containing emitters. These alkaline earth metals are present on the electrodes in the form of oxide compounds which are bound or are not bound to tungsten. A fraction of these oxide compounds will be present in a gaseous phase in the discharge vessel. The quantity represented by the fraction depends on the vapor pressure to the relevant oxidic compounds at the prevailing temperature. Under the influence of the discharge occurring in the discharge vessel, oxygen is released from the oxidic compounds, it being assumed that the oxygen is released from these constituents of the oxidic compounds in the gaseous phase. The released oxygen then gives rise to stable sodium compounds. It has been found that the alkaline earth metal oxides suitable for use as emitters have a comparatively high vapor pressure in the circumstances which prevail during operation in the discharge vessel. Materials such as thorium oxide and yttrium oxide are less efficient as emitters than the alkaline earth metal oxides, it is true, but they have the advantage of having a very low vapor pressure in the corresponding conditions and are consequently suitable for use as emitters in the discharge vessel.

In an advantageous embodiment of a lamp in accordance with the invention the relation $2 \leqq I/(d_{eff})^{3/2} \leqq 5$ is satisfied in the operating condition of the lamp, wherein I is the lamp current in amps, and $d_{eff}$ is the effective diameter of the electrode is mm.

$d_{eff}$ of the electrode is to be understood to mean herein the diameter of a solid, circular-cylindrical rod of the same length and the same material as the electrode, which rod has the same properties as the electrode as regards the heat dissipation from the tip.

A lamp according to this embodiment has for its advantage that it is achieved in a simple manner that in the operating condition of the lamp the electrode tip assumes a temperature which lies in the interval required according to the invention, the use of separate auxiliary means being dispensed with.

A high-pressure sodium vapor discharge lamp having two electrodes which are constructed as tungsten pins and have a diameter of approximately 0.5 mm is known per se from U.S. Pat. No. 3,476,969. This lamp which dissipates a power of 175 to 200 W in the operating condition has a partial mercury pressure of approximately 5 atmospheres. From this it can be derived that the lamp has a large arc voltage (in the order of magnitude of 500 V) and a small lamp current in the order of 0.5 A during operation. This involves that the lamp shown has too thick electrodes so that the danger exists that the lamp will operate in an unstable manner.

In lamps according to the invention the rare gas is preferably xenon which at 300 K has a pressure of at least 6.7 kPa and (50 torr) and which serves as a buffer gas as well as a starting gas. The electrode substantially comprises tungsten and is emitter-free. High-pressure xenon proves to have the advantage that blackening of the discharge vessel as a result of electrode material sputtered and evaporated during the starting phase is counteracted.

In an embodiment of a lamp in accordance with the invention the lamp in the operating condition dissipates a power of a value of at most 100 W and the electrode is a pin and in the operating condition the relationship is satisfied $2 \leqq I/d^{3/2} \leqq 5$ wherein I is the lamp current in amps, and d is the pin diameter in mm.

The advantage of this embodiment is that a lamp has been realized which is suitable for indoor illumination and the manufacture of which is comparatively simple since a simple pin may be used as a current supply conductor the diameter of which can be chosen to be substantially equal to that of the electrode pin.

Figure 2:
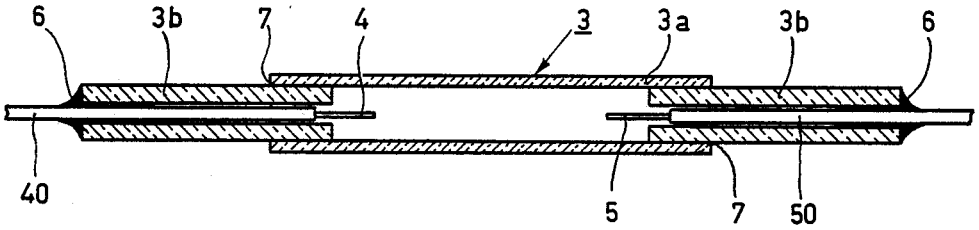

An embodiment of a lamp according to the invention will now be described in greater detail with reference to the drawing, in which FIG. 1 shows diagrammatically a lamp according to the invention, and FIG. 2 is a sectional view of the discharge vessel showing the lamp in greater detail.

The lamp shown in FIG. 1 has an outer envelope 1 provided with a lamp cap 2. The outer envelope encloses a discharge vessel 3 which has two electrodes 4, 5. Electrode 4 is connected to a connection contact of the lamp cap 2 by means of a current supply conductor 8. Electrode 5 is connected in an analogous manner by means of a current supply conductor 9.

The discharge vessel 3 as shown in FIG. 2 comprises a discharge space enclosed by an elongate tubular wall portion 3*a*, which wall portion has a respective end portion 3*b* at each end. The wall portion 3*a* and the end portions 3*b* consist of densely sintered aluminium oxide and are connected together by means of sintered joints 7. The external diameter of wall portion 3*a* is 3.5 mm. The discharge vessel encloses two electrodes 4, 5 which are constructed as tungsten pins and which are connected to pin-shaped current supply members 40, 50 of niobium. The electrode spacing is 11 mm. The pin-shaped current supply members 40, 50 are sealed to the end portions 3*b* in a gas-tight manner by means of a glass seal 6. The filling of the discharge vessel of the lamp described comprises xenon at a pressure of 50 torr at 300 K, and 10 mg of amalgam consisting of 27% by weight of Na and 73% by weight of Hg. The lamp is operated from a supply source of 220 V, 50 Hz via an inductive-stabilization ballast of 1.4H. For starting the lamp it is connected in parallel with a glow discharge starter. The power consumed by the lamp is approximately 30 W, the lamp current I being 0.04 A. The specific luminous efficacy is approximately 44 lm/W at a color temperature of the emitted radiation of 2450 K.

The pin-shaped tungsten electrodes of the lamp described have a diameter of 0.2 mm. This involves that the ratio $I/d^{3/2}$ has a value of approximately 4.4, which lies within the imposed range of 2 to 5. In the operating condition of the lamp the electrode tips of the electrodes 4, 5 assume a temperature of approximately 2600 K. The lamp described is particularly suitable for indoor illumination purposes and it has been found that no sodium disappearance occurs during the lifetime.

In order to find out the influence of the diameter of the electrodes a number of lamps have been made which are suitable to dissipate a power of 100 W during operation at a lamp current of 1.2 A. In the first lamp the diameter d of the electrodes constructed as tungsten pins is 0.5 mm. The lamp thus constructed had a stable operation while no evaporation of electrode material was observed. The $I/d^{3/2}$ is 3.4. In the second lamp the diameter of the pin-shaped tungsten electrodes was chosen to be equal to 0.7 mm. This lamp showed a small tendency to unstable operation. The ratio $I/d^{3/2}$ in this case is 2. In the third lamp the diameter d of the pin-shaped tungsten electrodes has been chosen to be equal to 0.3 mm so that the ratio $I/d^{3/2}$ is approximately 7, i.e. outside the range 2 to 5. In this lamp the discharge vessel shows blackening as a result of tungsten condensed on the wall.

In a further example of a lamp according to the invention the power dissipated by the lamp has a value of 400 W. The lamp current I is 3.2 A. The lamp has two electrodes constructed from a tungsten pin having a diameter of 1.2 mm provided near its tip with a tungsten coil. The coil consists of two rows of turns, the outermost row of turns having a largest diameter of 3.6 mm. The pitch of the turns is 0.6 mm, each row comprising approximately 10 turns of wire having a diameter of 0.6 mm.

The pin from which the discharge emanates during operation projects over a distance of 1.5 mm beyond the coil on the tip of the electrode, so that the heat dissipation properties on the tip side of the electrode will be influenced only to a small extent by the coil. As a result of this the effective diameter $d_{eff}$ will differ only slightly from the diameter of the pin and will be approximately 1.3 mm. For this lamp the ratio $I/(d_{eff})^{3/2}$ is approximately 2.2. The electrode tips in the operating condition of the lamp have a temperature of approximately 2500 K.

What is claimed is:

1. A high-pressure sodium vapor discharge lamp having a ceramic discharge vessel having a filling which contains sodium and a rare gas, a refractory metal electrode disposed in said discharge vessel, at least one current supply conductor extending through the wall of said vessel to said electrode, a discharge emanating from the tip of said electrode in the operating condition of the lamp, said electrode being free from alkaline earth metals and in the operating condition of the lamp the electrode tip having a temperature between 2400 K and 2700 K.

2. A lamp as claimed in claim 1 characterized in that, in the operating condition the lamp dissipates a power of a value of at most 100 W and that the electrode is a pin and that, in the operating condition, the relationship $2 \leqq I/d^{3/2} \leqq 5$ is satisfied, wherein I is the lamp current in amps, and d is the pin diameter in mm.

3. A lamp as claimed in claim 1 characterized in that the rare gas is xenon which at 300 K has a pressure of at least 6.7 kPa (50 torr), and that the electrode substantially comprises tungsten and is emitter-free.

4. A lamp as claimed in claim 3 characterized in that in the operating condition the lamp dissipates a power of a value of at most 100 W and that the electrode is a pin.

5. A lamp as claimed in claim 2, characterized in that the rare gas is xenon which at 300 K has a pressure of at least 6.7 kPa (50 torr), and that the electrode substantially comprises tungsten and is emitter-free.

6. A high-pressure sodium vapor discharge lamp having a ceramic discharge vessel having a filling which contains sodium and a rare gas, a refractory metal electrode disposed in said discharge vessel, at least one current supply conductor extending through the wall of said vessel to said electrode, a discharge emanating from the tip of said electrode in the operating condition of the lamp, said electrode being free from alkaline earth metals and in the operating condition of the lamp the electrode tip having a temperature between 2400 K and 2700 K, in the operating condition of the lamp the relation $2 \leqq I/(d_{eff})^{3/2}$ equal to or less than $\leqq 5$ is satisfied wherein I is the lamp current in A, and $d_{eff}$ is the effective diameter of the electrode in mm.

7. A high-pressure sodium vapor discharge lamp, comprising a ceramic discharge vessel, a filling within said vessel, comprising sodium and a rare gas, first and second metal electrodes disposed in said vessel, and first and second current supply conductors extending through the wall of said vessel and connected respectively to said electrodes, said vessel, electrodes and conductors being arranged such that in a normal operating condition of the lamp an electrical discharge extends between said electrodes, characterized in that at least one of said electrodes comprises a refractory metal free from alkaline-earth-metal-containing compounds, and said at least one electrode is arranged and said filling is selected such that in the normal operating condition of the lamp said at least one electrode tip has a temperature between 2400° K. and 2700° K.

8. A lamp as claimed in claim 7, characterized in that said electrodes are substantially identical, in the normal operating condition of the lamp each of said electrodes having a tip temperature between 2400° K. and 2700° K.

9. A lamp as claimed in claim 8, characterized in that each of said electrodes consists essentially of tungsten.

10. A lamp as claimed in claim 8, characterized in that each of said electrodes consists essentially of tungsten and at least one metal oxide emitter having a vapor pressure during normal operation of the lamp substantially lower than that of alkaline-earth- metal oxide emitters.

11. A lamp as claimed in claim 10, wherein said metal oxide comprises thorium oxide.

12. A lamp as claimed in claim 10, wherein said metal oxide comprises yttrium oxide.

13. A high-pressure sodium vapor electric discharge lamp that dissipates no more than 100 watts during lamp operation, comprising:

a tubular light transmissive discharge vessel;

a pair of refractory metal pin electrodes within said discharge vessel, said pin electrodes being comprised of tungsten and positioned axially of said discharge vessel and spaced apart to define a discharge gap between them, and said pair of pin electrodes being free of alkaline earth metals and oxides thereof;

a quantity of sodium amalgam within said discharge vessel which is ionized during lamp operation to emit light;

xenon gas within said discharge tube and having a pressure of at least 50 torr when said xenon gas is at a temperature of 300° K.;

said pin electrodes having effective diameters for developing electrode tip temperatures in the range of 2400° K. to 2700° K. during lamp operation; and said pin electrode effective diameters, xenon pressure and absence of alkaline earth metal oxides being effective to substantially avoid sodium clean-up due to sodium reaction with oxygen within the lamp discharge and to also avoid substantial discharge vessel darkening due to deposition of tungsten products on said discharge vessel.

14. A high-pressure sodium vapor electric discharge lamp according to claim 13, wherein said electrodes are entirely free of emitter material.

15. A high-pressure sodium vapor electric discharge lamp according to claim 13, wherein said electrodes have an emitter material having a partial vapor pressure within the operating lamp substantially less than the partial vapor pressure of alkaline earth metal oxides.

16. A high-pressure sodium vapor electric discharge lamp according to claim 13, wherein said electrodes have an emitter material free of alkaline earth metal oxides and comprising yttrium oxide.

17. A high-pressure sodium vapor electric discharge lamp according to claim 13, wherein said electrodes have an emitter material free of alkaline earth metal oxides and comprising thorium oxide.

18. A high-pressure sodium vapor electric discharge lamp according to claim 13, wherein said electrodes are entirely free of emitter material.

19. A high-pressure sodium vapor electric discharge lamp according to claim 13, wherein said electrodes have an emitter material having a partial vapor pressure within the operating lamp substantially less than the partial vapor pressure of alkaline earth metal oxides.

20. A high-pressure sodium vapor electric discharge lamp according to claim 13, wherein said electrodes have an emitter material free of alkaline earth metal oxides and comprising yttrium oxide.

21. A high-pressure sodium vapor electric discharge lamp according to claim 13, wherein said electrodes have an emitter material free of alkaline earth metal oxides and comprising thorium oxide.

22. A high-pressure sodium vapor electric discharge lamp that dissipates no more than 100 watts during lamp operation, comprising:

a light transmissive discharge vessel;

a pair of tungsten electrodes within said discharge vessel, positioned axially of said discharge vessel and spaced apart to define a discharge gap between them, and said pair of tungsten electrodes being free of alkaline earth metals and oxides thereof;

a quantity of sodium amalgam within said discharge vessel which is ionized during lamp operation to emit light;

an inert buffer gas within gas discharge tube and having a pressure of at least 50 torr when said buffer gas is at a temperature of 300° K.;

said tungsten electrodes having effective diameters for developing electrode tip temperatures in the range of 2400° K. to 2700° K. during lamp operation; and said tungsten electrode effective diameters, inert buffer gas pressure and absence of alkaline earth metal oxides being effective to substantially avoid sodium clean-up due to sodium reaction with oxygen within the lamp discharge and to also avoid substantial discharge vessel darkening due to deposition of tungsten products on said discharge vessel.

* * * * *